United States Patent [19]

Snyder et al.

[11] 4,167,426

[45] Sep. 11, 1979

[54] METHOD FOR ANNEALING SILICON STEEL

[75] Inventors: Ralph E. Snyder, Export; Philip R. Robinson, New Kensington, both of Pa.

[73] Assignee: Allegheny Ludlum Industries, Inc., Pittsburgh, Pa.

[21] Appl. No.: 898,010

[22] Filed: Apr. 20, 1978

[51] Int. Cl.[2] ..... H01F 1/04

[52] U.S. Cl. ..... 148/113; 148/16; 266/251; 266/252; 266/257

[58] Field of Search ..... 148/16, 113; 266/251, 266/252, 257

[56] References Cited

U.S. PATENT DOCUMENTS

| | | | |
|---|---|---|---|
| 2,955,062 | 10/1960 | Cullen et al. | 266/251 |
| 3,606,289 | 9/1971 | Bloom | 266/252 |
| 3,778,221 | 12/1973 | Bloom | 266/252 |

*Primary Examiner*—L. Dewayne Rutledge
*Assistant Examiner*—John P. Sheehan
*Attorney, Agent, or Firm*—Vincent G. Gioia; Robert F. Dropkin; William J. O'Rourke, Jr.

[57] ABSTRACT

Individual charges of silicon steel are passed through a tunnel type furnace provided with charge and discharge vestibules. The annealing takes place in a hydrogen atmosphere and the vestibules are purged with nitrogen and then with hydrogen. The hydrogen used for purging is taken from the hydrogen in the annealing atmosphere and additional new hydrogen is added to the annealing atmosphere at the same time to maintain the pressure constant.

3 Claims, 1 Drawing Figure

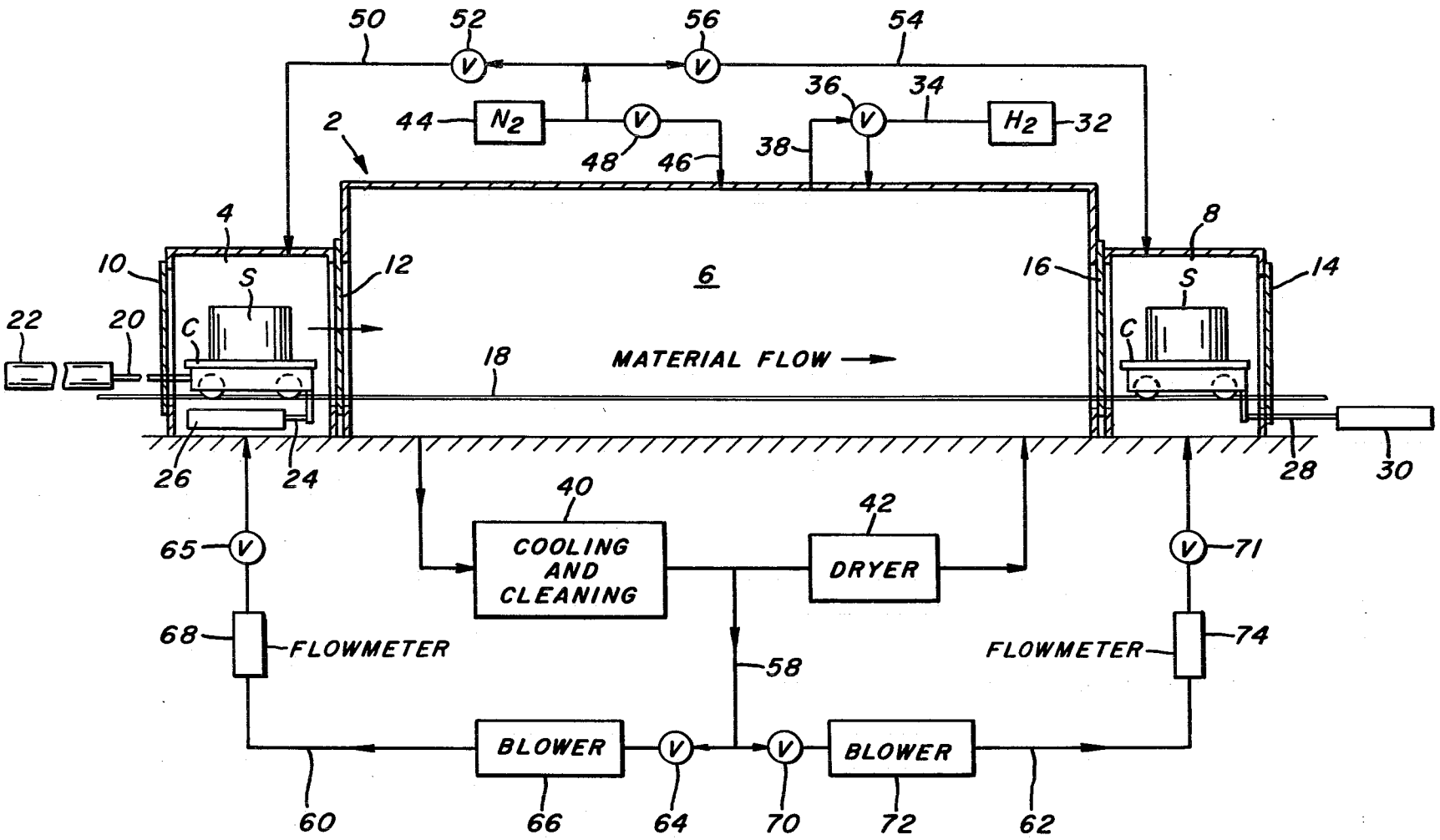
MATERIAL FLOW
DRYER
COOLING AND CLEANING
FLOWMETER
FLOWMETER
BLOWER
BLOWER
$H_2$
$N_2$
S
C
S
C
V

METHOD FOR ANNEALING SILICON STEEL

This invention relates to a method and apparatus for annealing steel and more particularly to annealing silicon steel and more particularly to annealing silicon steel in a tunnel furnace. Individual coils of silicon steel are arranged on separate cars and pass from a charge vestibule, through the furnace, and then through a discharge vestibule. A new car is added about every seventy minutes. Silicon steel is annealed in a hydrogen atmosphere where it is heated to a temperature as high as 2150° F. The hydrogen used is reconditioned in a circulating system. In order to function properly it is necessary to purge the air from the vestibule with nitrogen and then purge the nitrogen with hydrogen. This is done for each car load and each purge takes about ten or twelve minutes or a total of about twenty four minutes. The conventional method which has been in use for many years feeds the purging hydrogen from a conventional hydrogen source and the purging hydrogen is discharged to the atmosphere. This arrangement is very simple since no close control is required and it has no relationship to the furnace atmosphere. However, we have recently discovered that in some cases build up of carbon monoxide occurs which results in an inferior product.

According to our invention we take hydrogen from the circulating atmosphere for purging and add hydrogen from the hydrogen source to the circulating atmosphere. In one particular installation the circulating system rate is about 40,000 cu.ft. per hour and the amount of hydrogen required for purging is nearly 5000 cu.ft. which is supplied at a rate of about 24,000 cu.ft. per hour for a period of about 12 minutes. This creates problems since it is necessary to maintain a substantially constant pressure in the furnace. However, in spite of the rapid removal of hydrogen from the system we have solved these problems.

It is therefore an object of our invention to provide a method of annealing silicon steel which results in an improved product.

Another object is to provide annealing apparatus suitable for carrying out our method.

These and other objects will be more apparent after referring to the following specification and attached drawing in which the single FIGURE is a schematic view of a tunnel furnace with my invention incorporated therein.

Referring more particularly to the drawing, reference numeral 2 indicates a tunnel furnace having an entry vestibule 4, a main chamber 6, and an exit vestibule 8. The entry vestibule 4 has an outer door 10 and an inner door 12 which seals it from chamber 6. The exit vestibule has an outer door 14 and an inner door 16 which seals it from chamber 6. Rails 18 extend through the entire length of the furnace and extend from each end thereof. The rails support cars C on which are mounted coils of silicon steel strip S. The cars are charged into the entry vestibule 4 by means of a ram 20 moved by a fluid cylinder 22 and are moved into the main chamber 6 by means of a ram 24 moved by a fluid cylinder 26. The cars are discharged from the exit vestibule by means of a ram 28 moved by a fluid cylinder 30. The main chamber 6 is heated in any suitable manner.

Hydrogen is charged into the chamber 6 from hydrogen source 32 through a conduit 34 having a pressure control valve 36 therein. A conduit 38 leads from chamber 6 to control valve 36 so as to maintain the pressure in chamber 6 a slight amount above atmospheric such as 3 inches of water pressure. The hydrogen is circulated in any suitable manner from chamber 6 through cooling and cleaning apparatus 40 and a dryer 42 before returning to the chamber 6. Nitrogen for purging is supplied from nitrogen source 44 to chamber 6 through conduit 46 having a valve 48 therein, to entry vestibule 4 through conduit 50 having a valve 52 therein, and to exit vestibule through conduit 54 having a valve 56 therein. The apparatus so far described is conventional and the actual annealing cycle is also conventional.

According to our invention, we provide a conduit 58 from the hydrogen circulating system having a branch 60 leading to the entry vestibule 4 and branch 62 leading to the exit vestibule 8. The branch 60 includes valves 64 and 65, blower 66 and flowmeter 68. In like manner branch 62 includes valves 70 and 71, blower 72 and flowmeter 74. The blowers 66 and 72 may be of any conventional type, but we have found that a Roots XA Gas Pump manufactured by Dresser Industries, Inc. functions very well for this purpose. The Flowmeters 68 and 74 may be of any conventional type. The Waukee Flo-Meter manufactured by Waukee Engineering Company has proved suitable for this purpose.

In operation, with no charge in the furnace and the inner doors 12 and 16 closed, the furnace chamber 6 is purged with nitrogen and then filled with hydrogen. With at least door 10 open the cylinder 22 is operated to move a car C with a coil of silicon steel S thereon into entry vestibule 4. The door 10 is then closed, the valve 52 opened and the vestibule 4 purged with nitrogen after which valve 52 is closed. Flow-meter 68 is set for the desired hydrogen flow, valves 64 and 65 opened and blower 66 started into operation to feed hydrogen into the entry vestibule to purge it. As the hydrogen is taken from the circulating system including chamber 6, hydrogen is fed at the same rate into the circulating system by virtue of pressure control valve 36 opening as the pressure in the furnace chamber drops. When purging is completed the blower 66 is stopped and the valves 64 and 65 are closed. Inner door 12 is then opened and the car C pushed into furnace chamber 6 by operation of cylinder 26. Door 12 is then closed, door 10 is opened and another loaded car C is pushed into vestibule 4 after which the door 10 is closed. The operation is then repeated until the entire chamber 6 is filled with cars. As each car is pushed into chamber 6 it moves the cars already in the chamber ahead of it.

The furnace has now reached its normal operating position. In fact, even when the furnace is shut down it is normal practice to leave the furnace chamber 6 loaded with cars. At least outer door 10 is then opened and a car C charged into entry vestibule 4. With both outer door 10 and 14 and inner door 12 and 16 closed, valves 52 and 56 are opened to purge vestibules 4 and 8 with nitrogen after which valves 52 and 56 are closed. With flowmeters 68 and 74 set for the desired flow rate, valves 64, 65, 70 and 71 are opened and blowers 66 and 72 started in operation so that both vestibules are purged with hydrogen. Pressure control valve 36 will operate to cause fresh hydrogen to flow into the circulating system at substantially the same rate as hydrogen flows into the vestibules. The inner doors 12 and 16 are then opened and the car C in the entry vestibule 4 is pushed into furnace chamber 6, thus pushing the most forward car with its annealed coil into the exit vestibule 8. The inner doors 12 and 16 are then closed and the vestibules purged with nitrogen. The outer doors are then opened, the car removed from the exit vestibule 8 by operation of cylinder 30, and a car is fed into the entry vestibule 4. The cycle is then repeated.

As the hydrogen passes through the cooling and cleaning apparatus 40 and dryer 42 it is cooled, cleaned and dried as before in the usual manner. In one particular installation, a new charge on a car is added approximately every seventy minutes and each nitrogen and hydrogen purge requires approximately ten to twelve minutes with the amount of hydrogen used for each purging of each vestibule being approximately at least 5% of the circulating hydrogen. While the operation of the system has been described as manual it will be understood that in actual practice controls are provided for automatic operation. Since such controls are not part of the present invention they have not been shown or described. The annealing operation is otherwise the same as before applicants' invention.

While one embodiment has been shown and described in detail, it will be readily apparent to those skilled in the art that various adaptations and modifications may be made within the scope of the invention.

We claim:

1. An improved method for annealing a plurality of individual silicon steel charges in a tunnel furnace having a charge vestibule and a discharge vestibule at opposite ends of a main annealing chamber of the furnace, with each vestibule having an inner door and an outer door with respect to the main annealing chamber, which method comprises:

providing a plurality of silicon steel charges in the main annealing chamber of the furnace with the inner doors of the vestibules closed, providing a hydrogen atmosphere in the main annealing chamber of the furnace, circulating the hydrogen atmosphere through the main annealing chamber of the furnace by continuously feeding the hydrogen atmosphere from the main chamber of the furnace through a reconditioning apparatus and back to the main annealing chamber of the furnace, maintaining a substantially constant pressure in the main annealing chamber of the furnace, placing a cold silicon steel charge in the charge vestibule, with the charge vestibule doors closed, successively purging the charge vestibule first with nitrogen then with hydrogen, opening the inner door of the charge vestibule and moving the cold charge from the vestibule into the main annealing chamber of the furnace, after the charge has been annealed, purging the discharge vestibule with hydrogen, opening the inner door of the discharge vestibule and moving the annealed charge from the main annealing chamber to the discharge vestibule, closing the inner door of the discharge vestibule and purging the discharge vestibule with nitrogen, opening the outer door of the discharge vestibule, and removing the annealed charge from the tunnel furnace, wherein the improvement comprises:

intermittently removing a substantial amount of hydrogen from the circulating hydrogen atmosphere at a location upstream of the discharge end of the reconditioning apparatus, feeding the removed hydrogen to the respective charge and discharge vestibules when a hydrogen purge is required therein, and while removing hydrogen from the circulating hydrogen atmosphere, feeding hydrogen from a separate hydrogen source to the circulating hydrogen atmosphere in an amount sufficient to maintain the substantially constant pressure in the main chamber of the furnace.

2. The method of claim 1 in which the amount of hydrogen used for each purging of each vestibule is approximately at least 5% of the circulating hydrogen.

3. The method of claim 1 in which a charge is added to the charge vestibule approximately every 70 minutes, and each nitrogen and hydrogen purge requires approximately ten to twelve minutes.

* * * * *